US012163757B2

(12) United States Patent
Grace et al.

(10) Patent No.: US 12,163,757 B2
(45) **Date of Patent: *Dec. 10, 2024**

(54) ARCHERY BOW CAM SPACER

(71) Applicant: Grace Engineering Corp., Memphis, MI (US)

(72) Inventors: Nathaniel E. Grace, Fort Gratiot, MI (US); Scott C. Prater, Shelby Township, MI (US)

(73) Assignee: Grace Engineering Corp., Memphis, MI (US)

( * ) Notice: Subject to any disclaimer, the term of this patent is extended or adjusted under 35 U.S.C. 154(b) by 193 days.

This patent is subject to a terminal disclaimer.

(21) Appl. No.: 17/991,381

(22) Filed: Nov. 21, 2022

(65) Prior Publication Data

US 2023/0113520 A1 Apr. 13, 2023

Related U.S. Application Data

(63) Continuation-in-part of application No. 17/489,147, filed on Sep. 29, 2021, now Pat. No. 11,536,532.

(51) Int. Cl.
*F41B 5/10* (2006.01)

(52) U.S. Cl.
CPC ..... *F41B 5/105* (2013.01)

(58) Field of Classification Search
CPC ..... F41B 5/10; F41B 5/105
See application file for complete search history.

(56) References Cited

U.S. PATENT DOCUMENTS

| | | | | |
|---|---|---|---|---|
| 4,064,862 | A | 12/1977 | Groner | |
| 4,333,443 | A | 6/1982 | Roelle | |
| 5,390,655 | A | 2/1995 | Mitchell et al. | |
| 6,415,780 | B1 | 7/2002 | Proctor | |
| 6,474,324 | B1 | 11/2002 | Despart et al. | |
| 8,950,388 | B2 | 2/2015 | McPherson | |
| 9,115,953 | B1 | 8/2015 | Huang | |
| 9,528,788 | B2 | 12/2016 | McPherson | |
| 10,126,087 | B1 | 11/2018 | Grace et al. | |
| 11,536,532 | B1 * | 12/2022 | Grace | F41B 5/1403 |

OTHER PUBLICATIONS https://www.archerytalk.com/threads/e-clip.5329861/, downloaded Sep. 24, 2021.

* cited by examiner

*Primary Examiner* — John A Ricci
(74) *Attorney, Agent, or Firm* — Warner Norcross + Judd LLP

(57) ABSTRACT

An archery bow assembly is provided including an open sided spacer which is mountable to an axle on an archery bow and removable therefrom without removing the axle entirely or partially from a limb of the archery bow. The spacer can mount on the axle adjacent a cam rotatable on the axle, and can include an outer perimeter and an axle aperture. A recess can extend inward from the outer perimeter to the axle aperture so that the axle aperture and recess form a continuous opening. The spacer can be of a C-shape or E-shape. A cup spacer having an outer rim can capture the open sided spacer to secure it to the axle, yet still allow removal from the axle without removing the axle from the limb arms adjacent the cam. Related methods also are provided.

20 Claims, 13 Drawing Sheets

ARCHERY BOW CAM SPACER

BACKGROUND OF THE INVENTION

The present invention relates to archery products, and more particularly to a spacer to precisely position a cam on an axle of an archery bow.

Conventional compound and crossbow archery bows include a bowstring and a set of power cables that transfer energy from the limbs and cams, eccentrics or pulleys (which are all referred to generally as "cams" herein) of the bow to the bowstring, and thus to an arrow shot from the bow. The function of the cams is to provide a mechanical advantage so that energy imparted to the arrow is a multiple of that required of an archer to draw the bow. The cams typically are rotatably mounted to limbs via respective axles.

In most bows, a cam is rotatably mounted in a recess between free ends of a solid limb, or between two opposing limb arms of a split limb. An axle projects through the cam, and any associated bearings of the cam, as well as the free ends of the solid limb, or the opposing arms of a split limb. Sometimes, cylindrical bushings or circular washers are placed between the cam and the free ends or opposing arms of the limb to properly space or center the cam between those elements. To install these cylindrical bushings or circular washers, the axle must be removed from the limb, out from the limb recess, and then carefully redirected back into the limb recess, projecting through the center bore or hole of the cylindrical bushings or circular washers such that those elements are trapped on the axle.

While conventional cylindrical bushings or circular washers can position the cam between the free ends or opposing arms of a limb, they are tedious to install, and require full or partial removal of the axle from the limb and limb recess. Frequently, this requires that the bow be placed in a bow press to reduce the energy stored in the limbs so that the bow is safe to work on. This takes time and, of course, special equipment like a bow press. The components of the assembly, that is, the cam, the cylindrical bushings and/or the circular washers also have to be sequentially placed on the axle to ensure that the stack is appropriate along the axle, and achieves the desired placement of the cam along the axle. If the placement of a bushing or washer is improper, a user will remove the entire axle again to correct the misplacement. This can be tedious and time consuming. Likewise, if a bushing or washer of the wrong thickness is erroneously placed on the axle adjacent the cam, to replace that element with a correct or a better one, a user will remove the axle partially or fully from the limb.

Further, if a particular cylindrical bushing or circular washer is not of an appropriate thickness to provide a particular placement of the cam along the axle, an unwanted gap adjacent the cam or limb part can develop. As a result, the cam and components can slide laterally along the axle, which can lead to inconsistent and/or imprecise rotation of the cams. To replace the element, again, a user will use a bow press and remove the axle.

Accordingly, there remains room for improvement in the field of archery bows, and in particular, axle systems for rotating cams.

SUMMARY OF THE INVENTION

An archery bow assembly is provided including an open sided spacer which is mountable to an axle of an archery bow and removable therefrom without removing the axle from a limb of the archery bow.

In one embodiment, the spacer can mount on the axle adjacent a cam also mounted on the axle and rotatable thereto. The spacer can include an outer perimeter and an axle aperture. A recess can extend inward from the outer perimeter to the axle aperture so that the axle aperture and recess form a continuous opening.

In another embodiment, the open sided spacer can be of a C-shape or E-shape so that it can be frictionally pressed onto the axle and removed therefrom. The recess can have a recess width that is less than a diameter of the axle. The axle aperture can have a width that is equal to or greater than the diameter of the axle.

In still another embodiment, the spacer can be mounted to the axle by orienting the recess transverse to the axle. The spacer can be advanced toward a longitudinal axis of the axle in a direction that is transverse to the axis. The spacer can in some cases move radially inward toward the longitudinal axis.

In yet another embodiment, the spacer can be mounted on the axle and under compression between a limb arm and a cam or compression bearing. The spacer, cam and bearing can be clamped against one another, with zero gaps therebetween. Even under this compression, the cam can freely rotate relative to the axle between the limb parts and adjacent the open sided spacer mounted to the axle.

In even another embodiment, the spacer can include a friction feature in the recess that allows the spacer to be pressed on and off the axle, transverse to the longitudinal axis of the axle. In so doing, the axle passes through the recess and into the axle aperture where it settles. The axle thus can pass into and through a portion of the continuous opening in this installation.

In a further embodiment, the open sided spacer can be provided in a set, with different spacers in the set having different thicknesses. One spacer can be installed on one side of a cam, and another spacer on the other side of the cam. The spacers can be selected depending on their thicknesses to shift the cam, left and/or right along the axle, to adjust the center shot and/or tune of the bow.

In still a further embodiment, the set of different spacers can have multiple thicknesses that can be mixed and matched along the axle to properly position the cam along the axle. As one example, the set can include one or more first spacers having a first thickness of 0.100 inches, one or more second spacers having a second thickness of 0.130 inches, and one or more third spacers having a third thickness of 0.160 inches. Of course, the thicknesses can vary depending on the cam, the limb recess in which the cam rotates, and other factors.

In yet a further embodiment, the cam can include a bearing having an inner bearing portion and an outer bearing portion. The open sided spacer can be placed on the axle in contact with the inner bearing portion. The axle and/or a fastener joined with the axle can be operable in a compression mode to exert a compression force, such as an axial clamping force, against the spacer which engages the bearing inner portion so the bearing inner portion is non-rotatable relative to the axle, while the outer portion remains uncompressed and rotatable relative to the axle, along with the cam.

In yet a further embodiment, the compression force is an axial clamp force optionally of at least 1 pound, further optionally between 1 pound and 500 pounds.

In another embodiment, a method of using an archery bow assembly is provided. The method can include providing a bow with the above components, for example, providing an axle installed in opposing limb arms, with a cam rotatably mounted on the axle, and pressing an open sided spacer onto the axle in a direction transverse to the longitudinal axis of the axle until the axle enters an axle aperture of the spacer, without removing the axle from the limb.

In still another embodiment, the method can include loosening an axle compression fastener associated with the axle; sliding the axle through a recess of the spacer such that the recess expands in width until the axle enters the axle aperture.

In yet another embodiment, the method can include selecting different thickness open sided spacers; selectively placing a first spacer adjacent one side of the cam without removing the axle; selectively placing another spacer adjacent an opposite side of the cam; and tightening a fastener to exert a compression force on the first spacer, cam and the second spacer. The first and second spacers can have the same or different thicknesses depending on the positioning of the cam relative to the limb.

In even another embodiment, the method can include placing a spacer adjacent a bearing inner portion that is included in a bearing also having a bearing outer portion joined with a cam, exerting a compression force on the spacer between the bearing inner portion and a part of a limb, removing the compression force, and pushing the spacer off an axle while the axle remains mounted to the limb part. Optionally, the axle exits an opening of the spacer through an outer perimeter of the spacer, rather than through the axle aperture in which the axle is disposed in use on the bow.

In a further embodiment, a cup spacer can capture the open sided spacer to secure it to the axle, yet still allow removal from the axle without removing the axle from the limb arms adjacent the cam. The cup spacer can be placed adjacent the open sided spacer on the axle.

In still a further embodiment, the cup spacer can maintain the open sided spacer on the axle, and can include a rim that surrounds at least a portion of an outer dimension of the open sided spacer. Optionally, the rim can in some cases be round or circular, and can circumferentiate an outer diameter of the open sided spacer.

In yet a further embodiment, the cup spacer can form a cup bounded by the rim and a bottom wall of the cup spacer. A portion of the open sided spacer can nest within the cup, and can engage the bottom wall while being at least partially surrounded by the rim.

In even a further embodiment, a method is provided. The method can include placing the open sided spacer on an axle between a limb and a cam; moving the open sided spacer toward another spacer on the axle so that the open sided spacer engages the other spacer; and clamping the open sided spacer against the other spacer so that the open sided spacer is secured to the axle and unable to disengage the axle due to its interaction with the other spacer.

In another further embodiment, the method can include moving the open sided spacer into a cup defined by the other spacer so that the other spacer at least partially surrounds the open sided spacer.

In still another embodiment, the other spacer can include at least one of a projection and a recess, and the open sided spacer can include the other of a corresponding projection and recess. The projection and recess can interlock with one another in the clamping step to secure the open sided spacer to the axle.

The open sided spacer and archery bow of the current embodiments can provide an axle assembly that is easy to service and to adjust the centershot and/or tune of the bow. One or more spacers can be installed on and removed from the axle without removing the axle from an associated limb. This can reduce or eliminate the use of a bow press when adjusting or tuning the bow at the cams. In some cases, different spacers can come in a set of different thicknesses, and selected ones of the spacers can be quickly and easily mounted to the axle adjacent the cam to address cam lean, or to tune the bow. Where a secondary spacer is included, that secondary spacer can engage the open sided spacer and retain it on the axle so that the open sided spacer will not dislodge from the axle under a significant force or impact.

These and other objects, advantages, and features of the invention will be more fully understood and appreciated by reference to the description of the current embodiment and the drawings.

Before the embodiments of the invention are explained in detail, it is to be understood that the invention is not limited to the details of operation or to the details of construction and the arrangement of the components set forth in the following description or illustrated in the drawings. The invention may be implemented in various other embodiments and are being practiced or being carried out in alternative ways not expressly disclosed herein. Also, it is to be understood that the phraseology and terminology used herein are for the purpose of description and should not be regarded as limiting. The use of "including" and "comprising" and variations thereof is meant to encompass the items listed thereafter and equivalents thereof as well as additional items and equivalents thereof. Further, enumeration may be used in the description of various embodiments. Unless otherwise expressly stated, the use of enumeration should not be construed as limiting the invention to any specific order or number of components. Nor should the use of enumeration be construed as excluding from the scope of the invention any additional steps or components that might be combined with or into the enumerated steps or components.

DESCRIPTION OF THE CURRENT EMBODIMENTS

Figure 1:
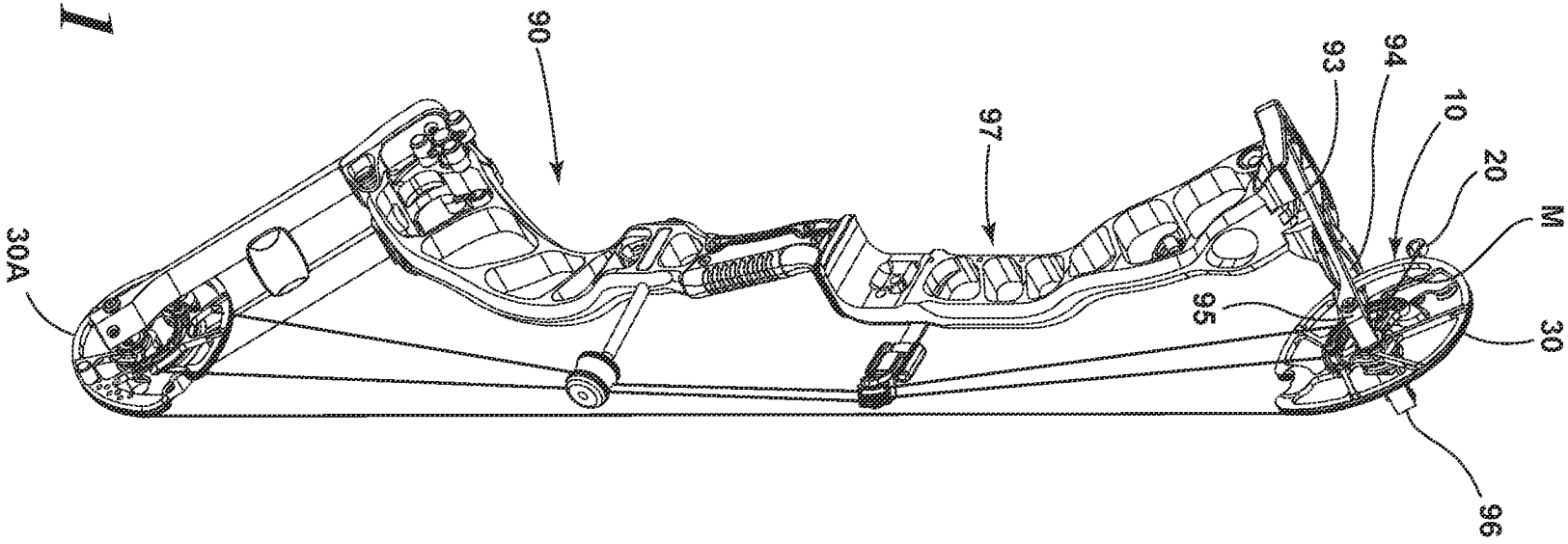
FIG. 1 is a perspective view of an archery bow including an open sided spacer and axle assembly of a current embodiment.

A compound archery bow including one or more cams and an archery bow assembly in accordance with a current embodiment is illustrated in FIGS. 1-7 and generally designated 10. The bow 90 can include a cam 30, which optionally is part of a dual cam system on the bow 90. The cam 30 can include one or more tracks 31, 32, which can be bowstring tracks, a power cable track or other tracks suitable to receive and guide elongated elements such as bowstrings and power cables.

The cam 30 can be mounted to a limb 93, which can be joined with the riser 97 of the bow. The exemplary cam 30 illustrated can be an upper cam, and the bow 90 can include another lower cam 30A spaced apart from the upper cam 30 and of a similar configuration. The limb 93 can be in the form of a split limb, including a first arm, first sub limb or limb portion 95 and a second arm, second sub limb or limb portion 96 that are separated from one another along respective lengths of each of the first sub limb and the second sub limb. Although shown in connection with a split limb, the current embodiments are well suited for solid limbs having limb portions separated somewhere along their length to accommodate a rotating body, as well as limbs having axle systems mounted to pillow blocks that are further mounted to the limbs. Where an axle assembly or its components are described herein as being joined with or in some orientation relative to an arm, a limb and/or limb portion, that arm, limb and/or limb portion can be any portion of any type of a limb, limb arm or portion, pillow blocks and/or other mounting structures associated with the arm, limb and/or limb portion. The limb 93 can define a limb recess 94. As used herein a limb recess can be formed by a solid limb, between free ends or arms of the solid limb, and/or between separate arms or mini-limbs of a split limb.

The cam 30 can be rotatably mounted to the limb 93 via the axle 40. Optionally, the axle assembly can include a first bearing 50 comprising a first inner portion 51 and a first outer portion 52. The first outer portion 52 can be non-rotatably engaged with the cam 30. The first inner portion 51 can be mounted immediately adjacent the axle 40, and optionally non-rotatable relative to the axle 40. Between the inner portion and the outer portion, ball bearings, pins, rollers or the like can be disposed so that the outer portion 52 rotates freely relative to the inner portion 51.

Further optionally, the axle 40 can include one or more fasteners 40A joined with the axle and operable in a compression mode to thereby compress under a compression force the first inner portion of the first bearing between a first end 41 and the second end 42 of the axle. The first outer portion 52 remains uncompressed when the compression force is applied to the first inner portion 51. As a result, the first outer portion 52 and the cam 30 are rotatable relative to the axle 40, while the first inner portion 51, and any open sided spacers 20, 20A mounted on the axle are non-rotatable relative to the axle 40 under the compression force.

The various other components aligned along the axle, immediately adjacent the axle (other than the cam and the outer portion of any bearings) can be clamped under the compression force, which can be an axial clamping force, between the ends of the axle 40, so they will not rotate upon rotation of the cam under normal circumstances. In this clamped configuration, the components along the axle have zero gaps or tolerances between them individually and the limbs. Indeed, these components can be clampingly forced against one another under a compression force, for example, an axial clamping force of optionally at least 1 pound, further optionally at least 5 pounds, yet further optionally at least 10 pounds, even further optionally at least 20 pounds, still further optionally at least 30 pounds, yet further optionally at least 40 pounds, further optionally at least 50 pounds, yet further optionally at least 100 pounds, still further optionally at least 250 pounds, still even further optionally at least 500 pounds, still further optionally between 1 pound and 500 pounds.

Although the current embodiment is described in connection with a dual cam bow, and in particular a binary cam system, the current embodiment and its features are suited for use with simpler pulley systems, for example, in single cam systems. The axle assembly, limb, cam and other features also can be used in other dual cam, cam and a half, and single cam systems as well. Further, the embodiments herein are well suited for compound archery bows, dual cam bows, cam and a half bows, crossbows and other archery systems including two or more cams. As used herein, a "cam" refers to a cam, a pulley, and/or an eccentric, whether a modular, removable part, or an integral part of a cam assembly, for use with an archery bow. However, when a cam is described as an "eccentric cam," this refers to a cam that rotates about an axis distal from a center of the body, for example a geometric center, and this term excludes perfectly circular pulleys such as those used in single cam archery bows.

As used herein, a "track" refers to a structural element that is adapted to guide or accommodate a portion of a bowstring or power cable within or adjacent the element, and can be in the form of a groove, a recess, a slot, pins or posts extending from or defined by a surface or element. When in the form of a groove or recess, that element can be defined by a part of a cam assembly, for example, defined by a bowstring cam and/or a power cable cam, and can be of virtually any geometric cross section, for example, partially or fully semi-circular, rounded, triangular, rectangular, square, polygonal, or combinations of the foregoing. The cam and/or module can be formed from rigid material, such as a metal, optionally aluminum, titanium, or magnesium, or a non-metal, optionally composites and/or polymers.

As used herein, an "axis of rotation" refers to an axis about which a cam can and/or does rotate, for example, a rotational axis of cam 30. Optionally, the axis of rotation can coincide with the longitudinal axis LA of axle 40 to which the cam is mounted. Although not described in detail, the cam herein can include modular elements that provide some level of adjustment of a performance characteristic of a bow, including but not limited to, a particular draw length, draw stop or draw force for the bow. The assemblies also can include draw stops and other components common to cams as desired.

Figure 2:
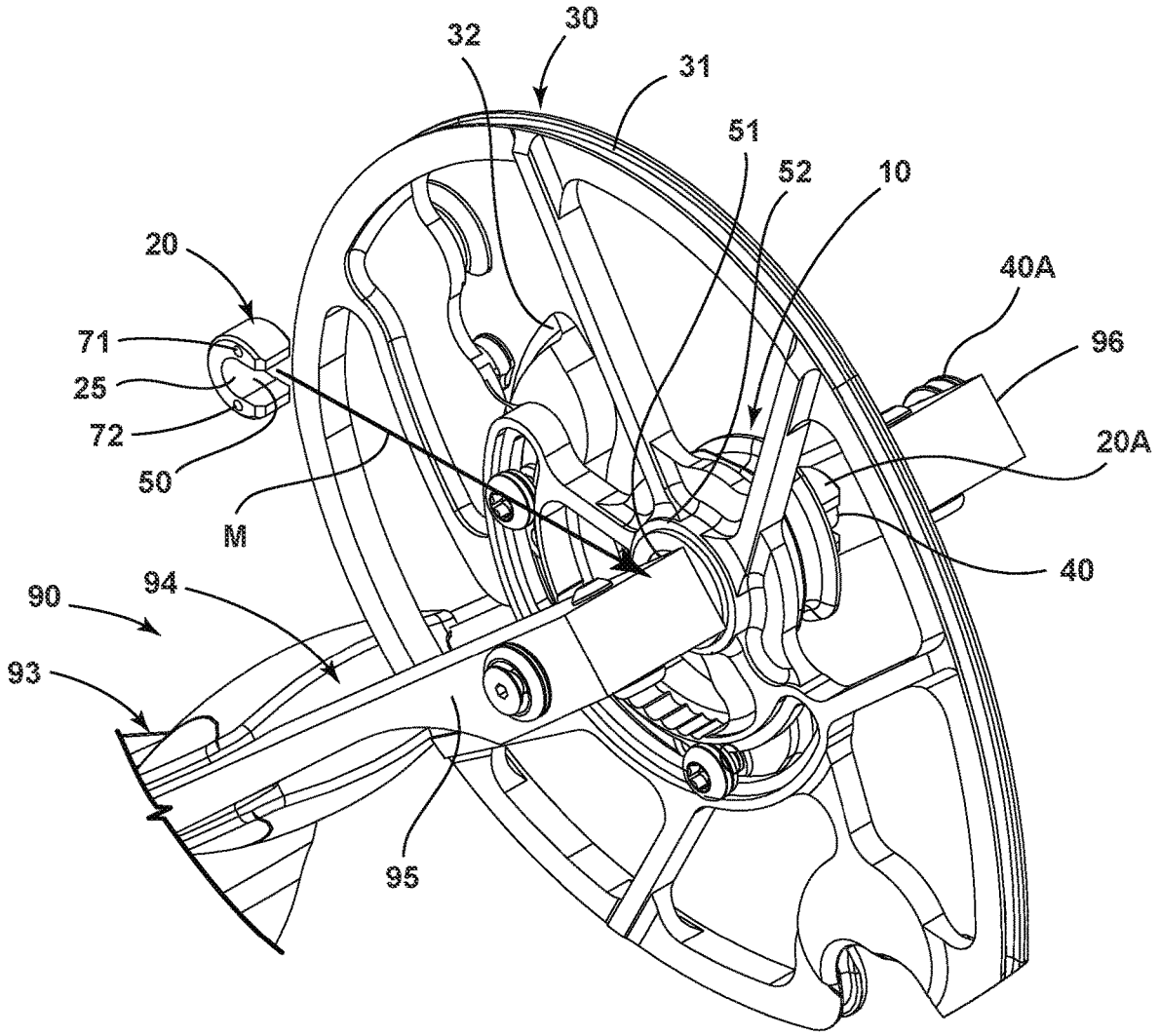
FIG. 2 is a close-up perspective view of the axle assembly and cam with one open sided spacer installed and another about to be installed on an axle.
Figure 3:
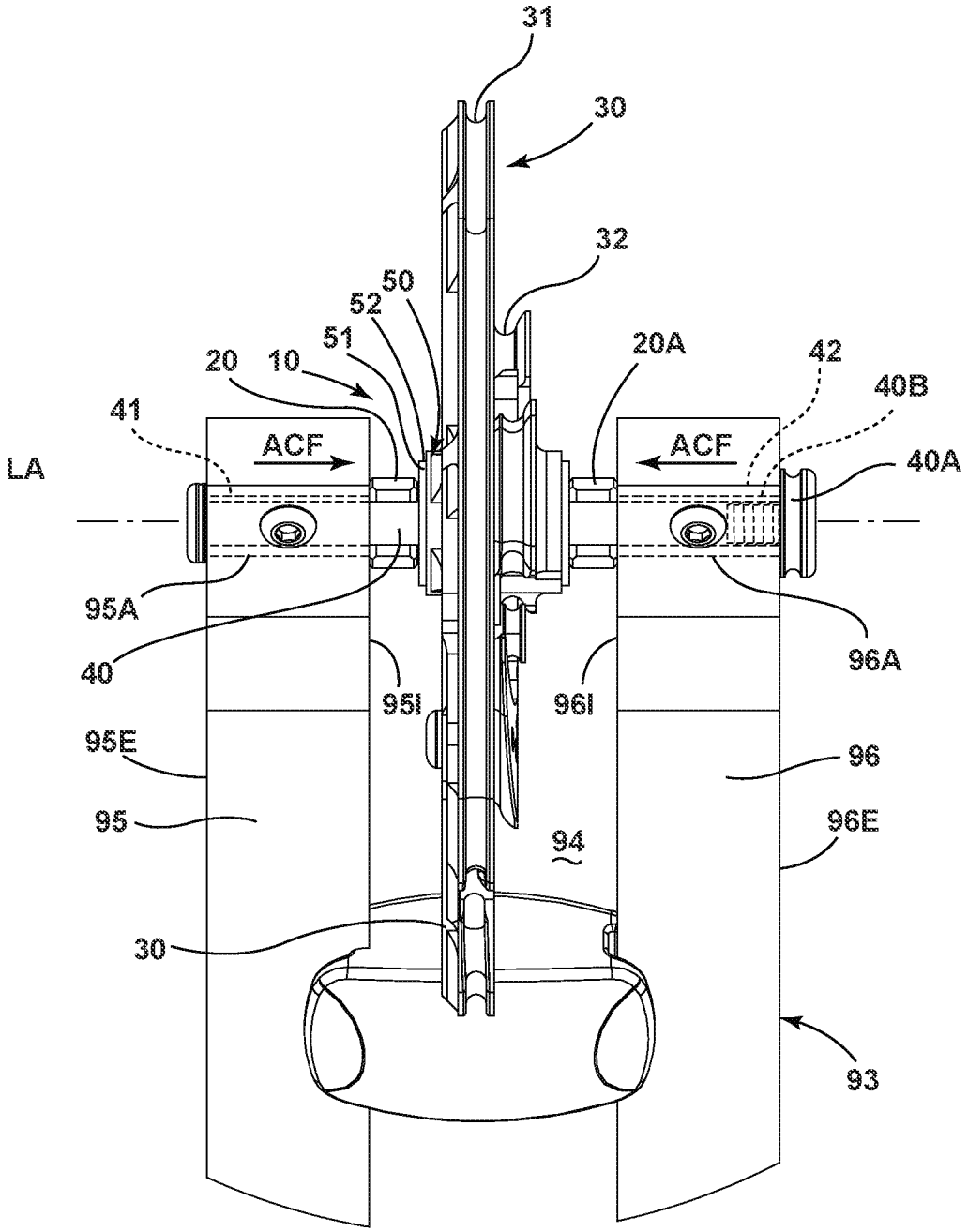
FIG. 3 is a close-up rear view of the open sided spacers fully installed on the axle and aligning the cam.

The cam 30 as mentioned above is rotatably mounted on the limb 93 which can include a first arm 95 and second arm 96. As shown in FIGS. 2-3, the axle 40 can project at least partially through a first aperture 95A defined by the first arm, which can be part of a split limb, a first portion of a solid limb and/or a pillow block, and through a second aperture 96A defined by the second arm which can be part of a split limb, a first portion of a solid limb and/or a pillow block. The cam 30 can be adapted to rotate about its axis of rotation, which coincides with the longitudinal axis LA of the axle 40.

The limb 93, that is, each of the sub limbs or other portions of a solid limb, or pillow blocks, can include an interior surface. For example, the first limb arm 95 can include an interior surface 951 and an exterior surface 95E. The other limb arm 96 can include an interior surface 951 and an exterior surface 95E. The interior surfaces of the limb portion can face toward the cam 30 and can directly engage the open face spacers 20, 20A as described below, while the exterior surfaces can face away from these elements. The interior surfaces, as described in further detail below also can contact and be clamped against under a compression force, one or more components that are disposed along the axle between the limb arms within the recess 94.

The axle as mentioned above can include first fastener 40A that is joined with the axle 40 at an axle end 42. Although shown as a single fastener, two fasteners can be used with the axle, installed at opposite ends thereof. In some cases, the axle 40 itself can be in the form of a large bolt or fastener (not shown) with a head disposed on the exterior surface 96E of one limb arm, and a nut (not shown) attached to threads that protrude from the exterior surface 95E of the other limb arm.

The axle in FIG. 3 can include a threaded bore 40B. The fastener 40A can be threaded into the bore 40B. When tightened, the fastener 40A can exert an axial clamping force ACF in the direction of the arrows. This axial clamping force ACF can be a compression force against all components that are disposed along the axle between the first end 41 and the second end 42 of the axle 40. These respective components, can be in direct engagement with one another. To the extent that other components, such as the outer portions of any bearings and the cam 30 are not engaged by other components under the axial compression force ACF, those components can be free to rotate about the axle 40.

When exerted, the axial clamping force ACF can be optionally at least 1 pound, at least 5 pounds, at least 10 pounds, at least 20 pounds, at least 30 pounds, at least 40 pounds, at least 50 pounds, at least 100 pounds, at least 250 pounds, at least 500 pounds, or between 1 pound and 500 pounds. The axial clamp force ACF can be significant enough that the components along the axle forcibly engage against one another so that rotation of those components clamped against one another is impaired and/or prevented. For example, to rotate one component relative to the next adjacent component, against which it is clampingly and forcibly compressed, one of the components will have exerted upon it a torque of optionally at least 1 inch pound, at least 5 inch pounds, at least 10 inch pounds, at least 15 inch pounds, at least 20 inch pounds, or between 1 inch pound and 100 inch pounds. In some cases, the axial clamping force ACF can not only set the gap or tolerance between components along the axle that are abutted against one another to 0.00 inches, but in addition, the axial clamping force ACF can press those components against one another forcefully enough under a compression or clamping force that the components do not rotate relative to one another along the axle without exertion of significant torque.

As shown in FIG. 3, when the axle 40 is assembled, the various components disposed between the limbs, optionally can be under a compression force, for example, the axial clamping force ACF described above. Under the axial clamping force ACF, the various components are pressed together and engage one another so that there optionally is zero gap or tolerance between each of the components. Further, these components, effectively can be clamped against one another and forcefully engage one another under that axial clamping force.

The open sided spacer 20 will be described in more detail with reference to FIGS. 2-7. The open sided spacer generally is removable without pulling or removing the axle 40 from the limb 93. In particular, the axle 40 can remain in engagement with the limb arms 95 and 96, such that the ends 41 and 42 remain associated with, joined with or contacting those limb arms. The axle is not withdrawn from the limb, so that it continues to extend within or across the limb recess 94, while installing, manipulating, servicing or removing the spacer 20.

The spacer 20 can include one or more friction elements 23 as described below that frictionally engage the spacer 20 as it is pressed or urged on and off the axle 40 during installation and/or removal. The spacer can be mounted on an axle 40 under compression force ACF, and installed or removed by loosening the fastener 40A to remove the compression force. Thereafter, a user can use a tool, such as a hammer or wrench to bump or nudge the open sided spacer 20 on or off the axle in a direction that is transverse to, rather than parallel to or aligned with, the longitudinal axis LA of the axle as described below. The spacers 20, 20A can be provided in a set, and can have similar or varying thicknesses. These same or varied thicknesses of the spacers can shift the cam 30 left and right along the axle 40 to modify, adjust and/or maximize the center shot or tune of the archery bow 90.

Figure 4:
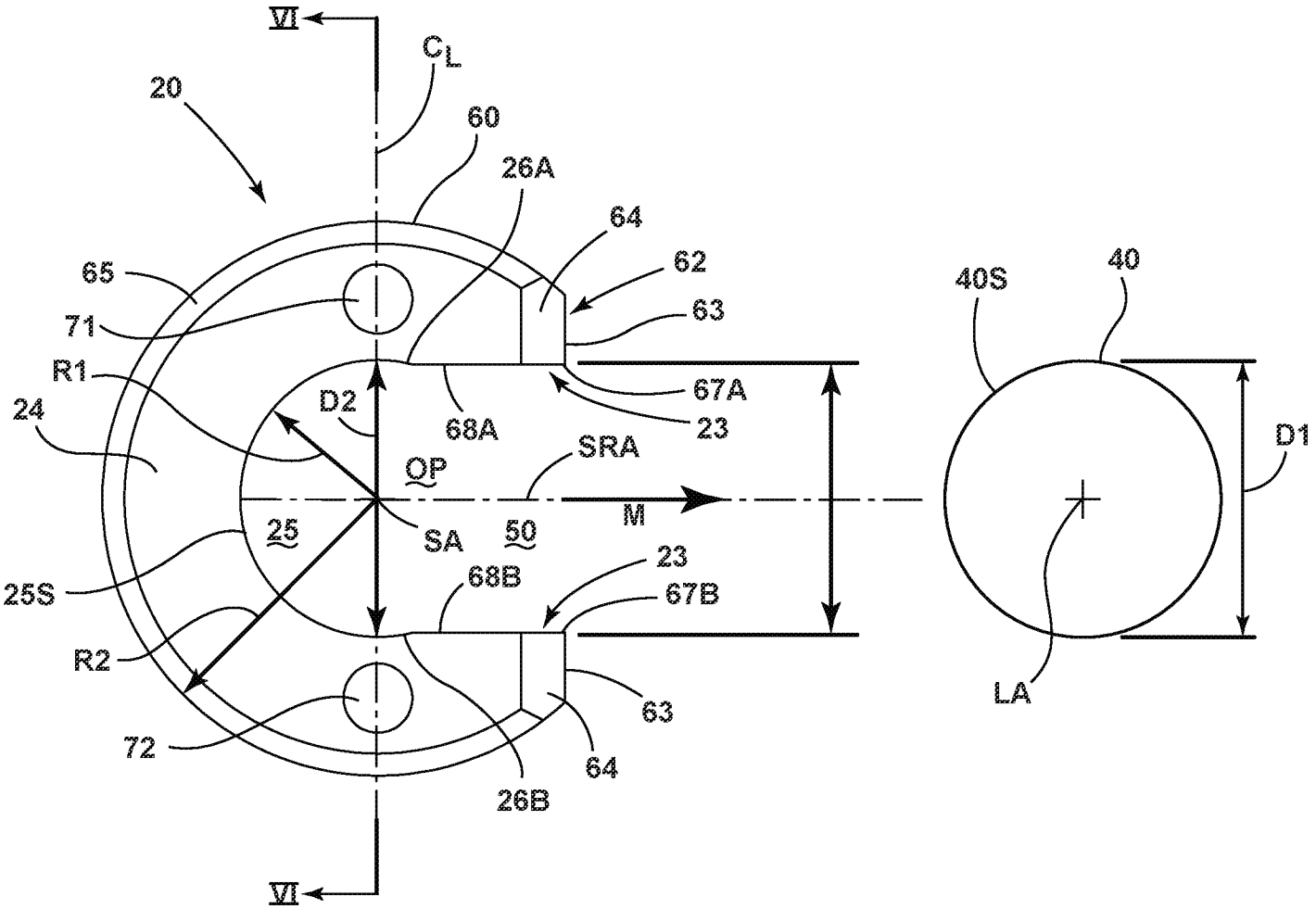
FIG. 4 is a side view of the open sided spacer and the axle.
Figure 5:
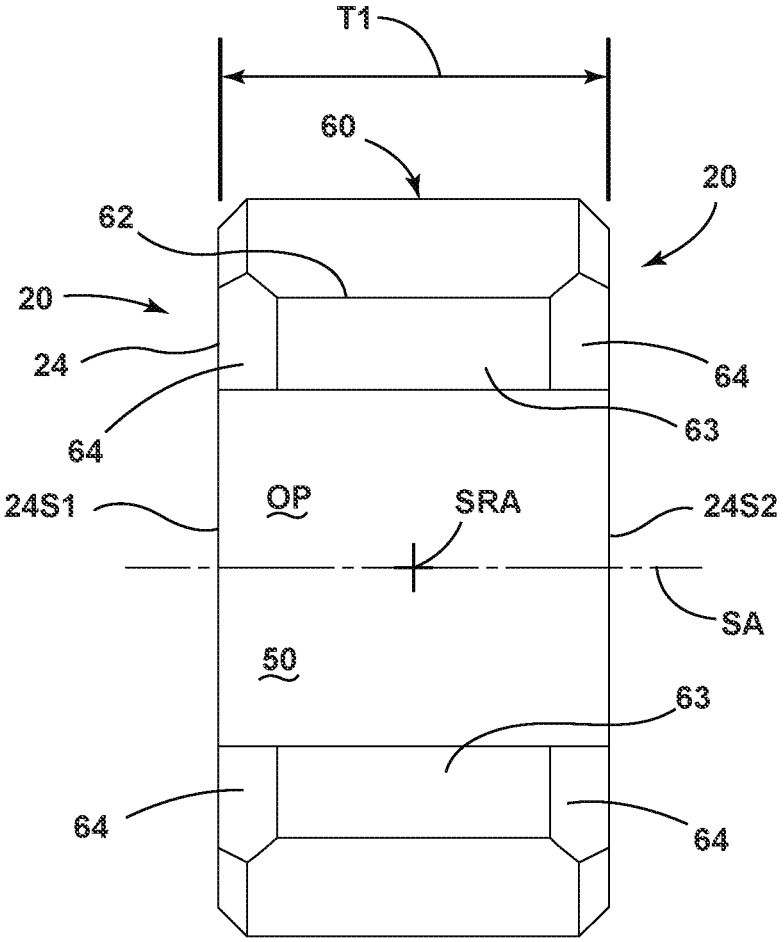
FIG. 5 is a front view of the open sided spacer.
Figure 6:
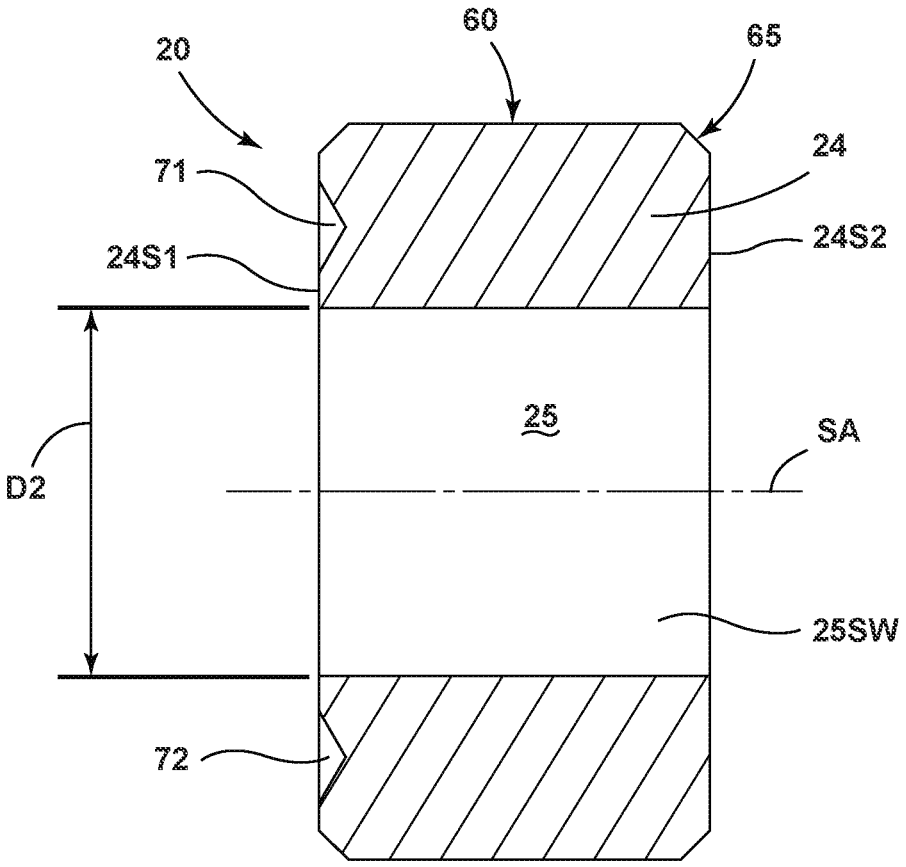
FIG. 6 is a section view of the open sided spacer taken along line VI-VI in FIG. 4.
Figure 7:
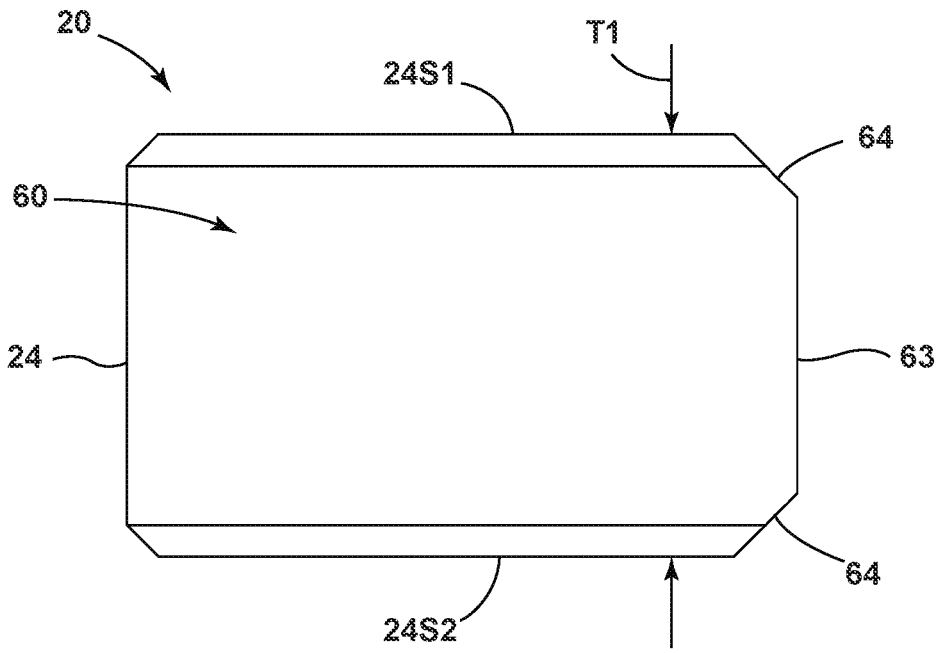
FIG. 7 is a top view of the open sided spacer with a first thickness.

With reference to FIGS. 4-6, the open sided spacer 20 can include a body 24 defining a longitudinal axis SA and axle aperture 25 that can be generally centered on the longitudinal axis SA. The axle aperture 25 can be configured to receive the axle 40 therein. The axle aperture can include a diameter D2 that is slightly greater than or equal to the diameter D1 of the axle 40 as shown in FIG. 4. The diameter D2 optionally can be about 0.25 inches, between about 0.10 inches and about 0.50 inches, between about 0.20 and about 0.40 inches, or other diameters depending on the size of the axle 40. The diameter D1 can be equal to or less than the diameter D2 such that the axle 40 can fit within and/or through the axle aperture 25, which can include a longitudinal axis SA.

When fully installed, the longitudinal axis SA of the axle aperture 25 can be aligned with the longitudinal axis LA of the axle 40. The axle aperture can include a radius around at least half of the aperture. The axle aperture 25 optionally can include a centerline CL. As shown in FIG. 4, to the left of the centerline CL, the aperture 25 can include a constant radius R1 extending to sidewall 25S of the axle aperture 25. The sidewall 25S can be partially or fully cylindrical, opening to the spacer recess 50 and extending outward to the outer perimeter 60 of the spacer body 20.

In particular, the spacer body 24 of the open sided spacer 20 can include an outer perimeter 60. This perimeter can extend around the outer periphery of the spacer body and can be interrupted by a spacer recess 50 that extends inwardly toward the longitudinal axis SA and toward the axle aperture 25 so the spacer recess and axle aperture form a continuous opening OP. With this continuous opening extending inwardly from the outer perimeter 60, the spacer body 24 optionally can take on a generally C-shape, U-shape or E-shape.

The outer perimeter 60 shown in FIG. 4 can extend about the longitudinal axis SA at a constant radius R2 to the left of the centerline CL. To the right of the centerline CL, the outer perimeter 60 can extend to an outer shoulder 62 at which the radius R2 stops. At the shoulder 62, the outer perimeter can transition to a face 63 which optionally can be bounded by chamfered, rounded or angled faces 64 on opposite sides of a spacer recess axis SRA that extends perpendicular or orthogonal to the longitudinal axis SA of the spacer body 24. Optionally, another chamfered, rounded or angled face 65 can extend around the perimeter on opposing lateral surfaces 24S1 and 24S2 of the spacer body 24. Although shown as angled or chamfered surfaces, the various surfaces and shoulder described above can be rounded to include radii, depending on the application.

The forward surfaces 63 above and below the spacer recess axis SRA can transition to engagement edges 67A and 67B. The engagement edges can be the portion of the spacer body 24 that first engage the axle 40 in particular its exterior side wall 40S, which optionally can be cylindrical. The edges 67A and 67B can form a corner with the respective recess sidewall 68A and 68B that extend inwardly and generally toward the centerline CL of the spacer body 24. The surfaces 63 and respective sidewalls 68A and 68B can optionally form right angles at the respective corners where they transition to one another. These right angles can include a small slightly radiused portion depending on the manufacturing techniques for forming the open sided spacer 20.

The open sided spacer optionally can be constructed from a variety of materials, such as metal, composites, polymer and or combinations thereof. The open sided spacer can be molded, machined, 3D printed or formed in a variety of other suitable manners. Optionally, the spacer body 20 can be constructed such that the spacer recess width D3 can be slightly increased when the spacer body 24 engages the axle 40 as described below.

Returning to FIGS. 4-6, the open sided spacer 20 can include the sidewalls 68A and 68B that extend inwardly toward the sidewall 25S of the axle aperture 25. The spacer recess sidewalls 68A and 68B can transition to the axle aperture sidewall 25S at respective shoulders 26A and 26B. The shoulders can transition from the rounded or cylindrical axle aperture sidewall 25S to the flat planar recess sidewalls 68A and 68B. The shoulders 26A and 26B can form subtle ridges at the inward end of the spacer recess 50. The shoulders 26A and 26B can be disposed sufficiently past the centerline CL so as to trap the axle 40 in the axle aperture 25 when the axle 40 is installed in the axle aperture 25 and the longitudinal axis LA of the axle 40 is generally aligned with the longitudinal axis SA of the spacer body 24. The shoulders 26A and 26B can be disposed at a distance D3 from one another that is less than the diameter D2 of the axle aperture and less than the diameter D1 of the axle 40.

Sometimes, when the shoulders are included, they can operate to lock the axle 40 in the axle aperture. Optionally, when the axle 40 is installed into the opening OP by moving the spacer 20 toward the axle 40 in direction M, the axle sidewall 40S slides along the respective sidewalls 68A and 68B of the recess 50. As this occurs, the axle frictionally engages these sidewalls due to the axle 40 having a diameter D1 that is greater than the recess width D3. In some cases, the recess width D3 can actually increase, with the edges 67A and 67B moving away from one another as the axle 40 enters the spacer recess 50, generally moving along the spacer recess axis toward the longitudinal axis SA of the axle aperture 25. Due to this friction fit, the sidewalls 68A and 68B also or alternatively can be urged away from one another slightly, as the axle 40 moves through the continuous opening OP. Eventually, when the axle 40 passes the shoulders 26A and 26B, and enters into the axle aperture 25, the sidewalls 68A and 68B can move back toward one another and the width of the recess D3 can return to its static condition.

As mentioned above, the spacer body 24 can include lateral surfaces 24S1 and 24S2. These surfaces can be separated by thickness T1. This thickness T1 can be optionally between about 0.005 inches and about 0.500 inches, between about 0.050 inches and about 0.400 inches, between about 0.050 inches and about 0.300 inches, between about 0.100 and about 0.275 inches, between about 0.250 inches and 0.27 inches, about 0.100 inches, about 0.130 inches or about 0.160 inches or other dimensions depending on the application and suitable spacing for the cam 30 along the axle, between the respective limb arms 95 and 96.

Figure 8:
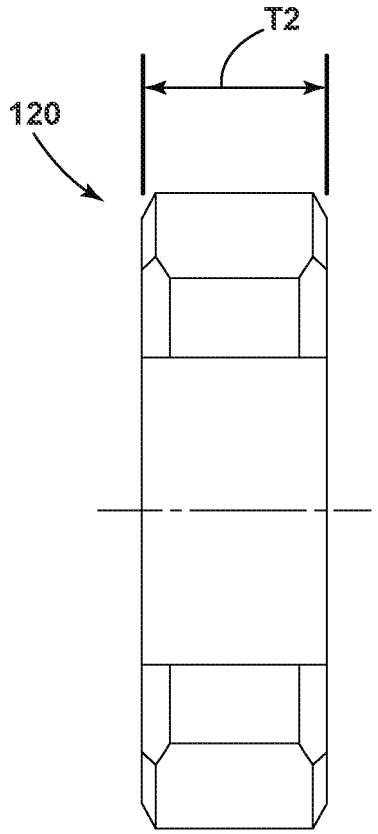
FIG. 8 is a front view of an alternative open sided spacer with a second thickness.
Figure 9:
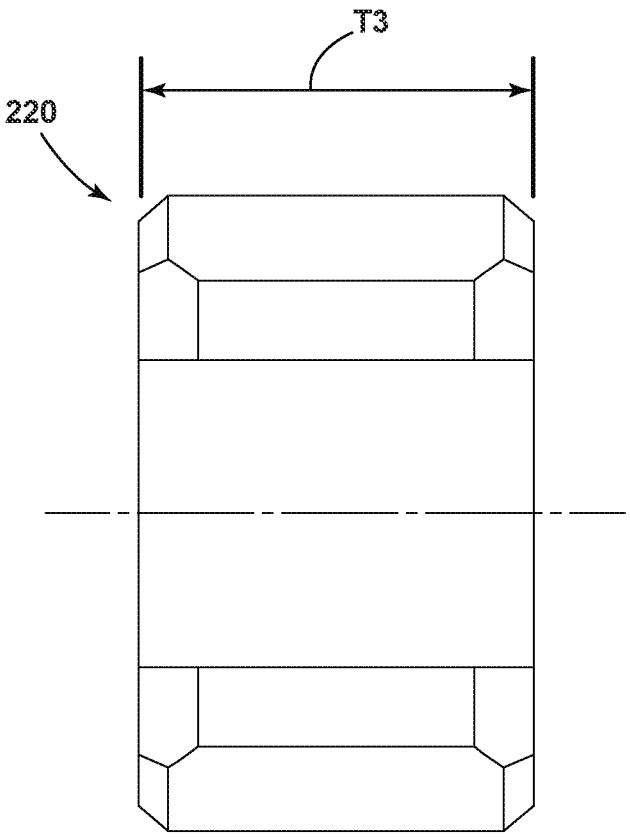
FIG. 9 is a front view of another alternative open sided spacer with a third thickness.

Optionally, the open sided spacer herein can be provided with varying thicknesses. For example, as shown in FIG. 8, an alternative embodiment of the spacer 120 can include a second thickness T2, with all the other components and structures of the spacer 120 being similar or identical to the spacer 20. As shown in FIG. 9, yet another alternative embodiment of the spacer 220 can include a third thickness T3, with all the other components and structures of the spacer 220 being similar or identical to the spacer 20. The second thickness T2 of the second spacer 120 can be less than the thickness T1 of the first spacer 20. The third thickness T3 of the third spacer 220 can be greater than the thickness T1 of the first spacer 20. Further optionally, a variety of spacers 20, 120 and 220 can be provided in a set and offered to consumers. There may be multiple ones of each of the spacers 20, 120 and 220 in the set. The spacers of varying thicknesses can be mixed and matched, and installed on the axle to precisely position the cam 30 along the axle 40, between the first axle end 41 and second axle end 42, to provide suitable tuning and center shot placement for the cam.

As shown in FIGS. 4 and 6, the open sided spacer 20 optionally can include indicia elements 71, 72. These indicia elements can represent the overall thickness T1 of the spacer body 24. These indicia elements 71, 72 as shown can be in the form of recesses defined in surfaces 24S1 or 24S2 of the spacer body 24. These recesses can be drilled or machined into those surfaces. Optionally, in some cases, the indicia elements can be in the form of projections that extend outward from one or more of the surfaces of the spacer body 24, for example, the outer perimeter 60 other surfaces. These indicia elements also can be of different shapes than the circular shape as shown. For example, they can be triangular shapes, polygonal shapes or alphanumeric characters that are printed on the side surfaces 24S1 or 24S2. In other cases, the characters can be printed on molded or stamped into the outer perimeter 60 so that they can be viewable at all times by a user to facilitate testing of different thickness spacers. Of course, with the alternative spacers 120 and 220, having different thicknesses T2 and T3, those spacers can include indicia elements that are different from the spacer 20 to represent the different thicknesses. In other cases, the spacer bodies can be painted, coded, anodized or otherwise include different colors to represent the different thicknesses T1, T2 and T3 or other thicknesses.

A method of using the archery bow assembly will be described with reference to FIGS. 1-4. In general, the method can include providing an axle 40 installed relative to opposing arms 95, 96 of a limb 93 of an archery bow 90, with a cam 30 rotatably mounted on the axle 40 in a limb recess 94 between the opposing arms and pressing an open sided spacer 20 onto the axle 40 within the limb recess in a direction M transverse to the longitudinal axis LA of the axle 40 such that the axle passes through a spacer recess 50 until the axle 40 enters an axle aperture 25 of the spacer 20. The open side spacer 20 is installed on the axle 40 without removing the axle from the opposing arms of the limb or the limb recess.

More particularly, as shown in FIGS. 2-4, the open side spacer 20 can be installed to adjust, modify or configure the cam 30 at a predetermined location along the axle 40 and in particular its longitudinal axis. This in turn can adjust the center shot or tune of the cam relative to the limbs and the remainder of the bow 90. To install and/or remove a spacer 20, 20A, a user can loosen the fastener 48 relative to the axle 40. If there is another fastener on the opposing side of the axle, that fastener (not shown) also can be loosened. As a result, the axial compression force ACF on the cam 30 and components between the respective limb arms 95 and 96 can be reduced and/or eliminated.

During installation or removal of an open face spacer, the user can leave the fastener 40A in the bore 40B and thus threaded in the axle 40. The axle likewise can remain installed relative to the limb 93. In particular, the first end 41 and second end 42 of the axle can remain installed in and engaging the respective limb arms 95 and 96. The axle ends 41 and 42 are not removed or pulled through the respective apertures 95A and/or 96A in which the axle is mounted, nor is the axle removed from the recess 94 between the limb arms 95 and 96 to install, remove and/or adjust the open sided limb spacers 20 and 20A. Further, it is noted that these actions can be taken with or without the use of a bow press compressing the limbs of the bow, optionally such that the spacers can be installed, removed and/or modified relative to the axle without the use of a bow press in some applications.

As shown in FIG. 2, after the fastener 40A is loosened to remove the axial compression force ACF between the limb arms 95 and 96 and other components, the open sided spacer can be selected for positioning along the axle 40. In some applications, the user can select it from a set of spacers to properly position the cam in a predetermined location along the axle. For example, a user can select one of the spacers 20, 120, 220 from a set of those spacer bodies. As noted above, the spacers can have different thicknesses T1, T2, T3 or the like. The user can install the spacer having a predetermined thickness on the axle. In some cases, the user can install one spacer having a first thickness on one side of the cam, and another spacer having the same or a different thickness, greater or lesser, than the first thickness on the other side of the cam. In other cases, a user can mix and match spacers on the same side of a cam depending on the application.

As mentioned above, the spacers optionally can include the indicia elements 71, 72 associated with a particular thickness. The user can use these indicia elements to identify a spacer having a particular thickness suitable for the application and installation on the axle.

To install the spacer 20 on the axle 40, the spacer 20 can be moved in direction M toward the axle as shown in FIGS. 2 and 4. This direction M can be transverse and optionally perpendicular to the longitudinal axis LA. The spacer 20 can be engaged against the axle 40 with the edges 67A and 67B initially engaging the exterior surface or wall 40S of the axle 40. The spacer recess axis SRA can be aligned with the longitudinal axis LA of the axle 40. The spacer can be pushed onto and pressed against the axle with a force of optionally at least 1 pound, at least 2 pounds, at least 3 pounds, at least 4 pounds, at least 5 pounds, at least 6 pounds, at least 7 pounds, at least 8 pounds, at least 9 pounds, at least 10 pounds, at least 20 pounds, at least 30 pounds, at least 40 pounds or other forces depending on the application. With this force, the distance D3 between the side walls 68A and 68B can increase slightly to accommodate the diameter D1 of the axle 40. The axle side wall 40S can frictionally slide along the recess side wall 68A and 68B until passing the shoulders 26A and 26B and entering the axle aperture 25 as described above. Optionally, the spacer and/or axle can make an audible snap when entering the axle, which indicates that the spacer is fully installed on the axle 40.

The spacer 20 can be installed along the axle within the limb recess 94. The spacer 20 can be positioned so that the spacer body 24 is mounted between the cam 30 and the limb arm 95, or the limb arm 96 so the spacer is in the location of the other spacer 20A as shown in FIGS. 2 and 3. The spacer 20 can be installed so that its lateral surfaces 24S1 and 24S2 are disposed between the cam 30, and any optional bearing 50, as well as between the interior surfaces 951 or 961 of the limb 93. The spacer body optionally is not placed along the axle 40 adjacent the exterior surfaces 95B or 96B of the limb 93.

Where the bearing 50 is included, the spacer body 20 can be placed adjacent the first inner portion 51 of the bearing, and distal from the first outer portion 52 of the bearing. The second lateral surface 24S2 can directly contact the first inner portion 51 of the bearing. The first lateral surface 24S1 can directly contact the interior surface 951 of the limb arm 95. Generally, the second lateral surface can face away from the cam 30 and the first lateral surface can face toward the cam.

The process mentioned above for installing the open sided spacer 20 can be repeated for another spacer 20A, or the alternative spacers 120, 220 or additional spacers along the axle within the recess 94. Again spacers of the same width or of different widths can be mixed and matched for installation on the axle depending on the application.

With the spacers installed, and in cases where the archery bow assembly 10 utilizes a compression system, an axial compression force ACF can be applied to the assembly 10. To do so, a user can rotate the fastener 40A relative to the axle 40 thereby providing the axial compression force ACF. This in turn exerts the compression force on the open sided spacers 20, 20A, as well as the inner portions of the bearings and optionally the cam 30 located between the arms 95 and 96. The compression force can be any of the compression forces mentioned above, for example, between 1 pound and 500 pounds.

The first outer portion, 52, however, can remain uncompressed, unclamped, and not under the axial clamping force ACF when that axial clamping force is applied to the first inner portion. As a result, the first outer portion 52 of the bearing and the cam 30 are free to rotate relative to the axle 40, while the first inner portion 51 can remain nonrotating relative to the axle 40 and the spacer 20 under the axial clamping force ACF.

Figure 10:
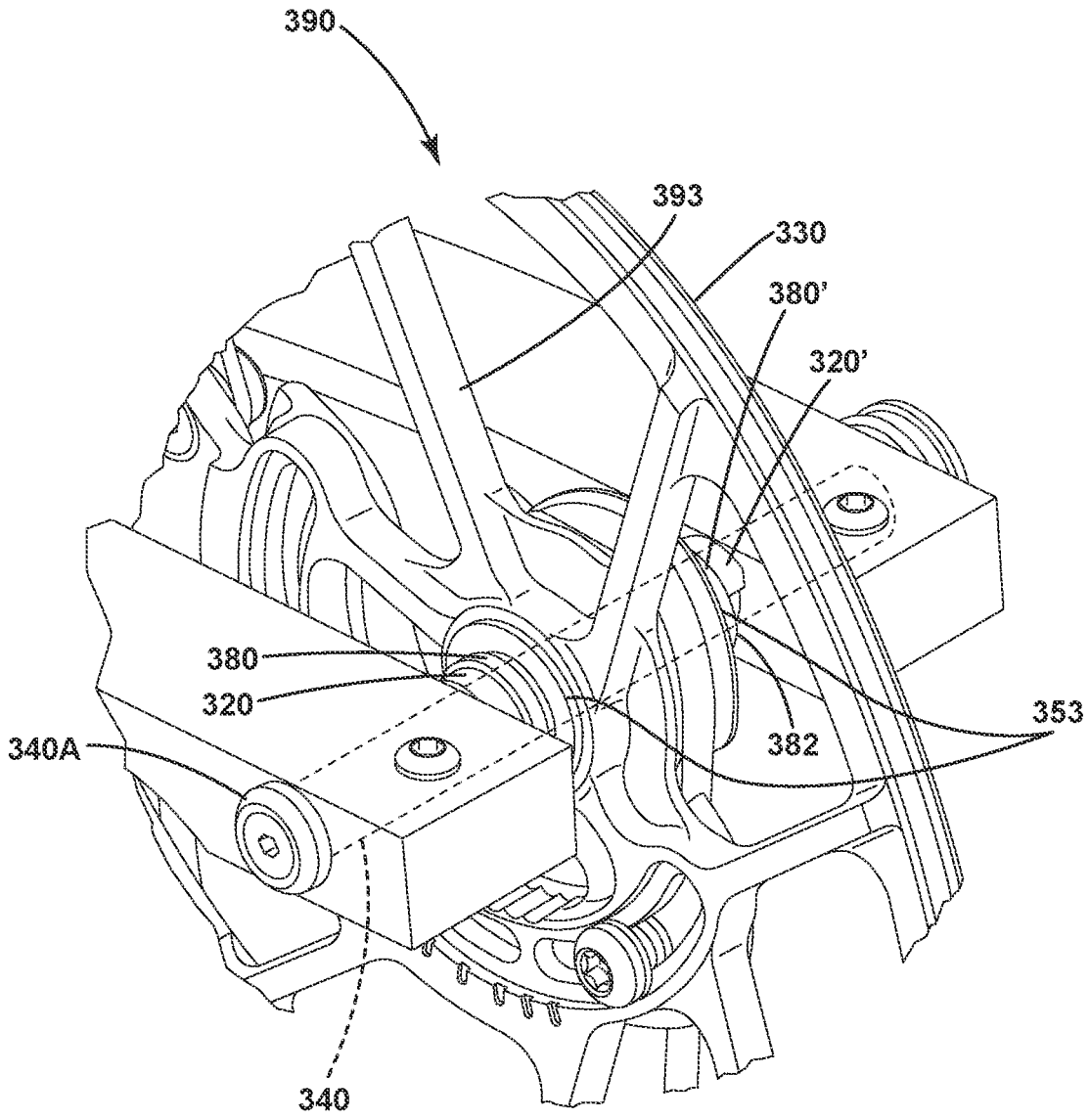
FIG. 10 is a close-up perspective view of an archery bow including an open sided spacer and axle assembly of a first alternative embodiment, further including a secondary spacer to secure the open sided spacer to the axle.
Figure 11:
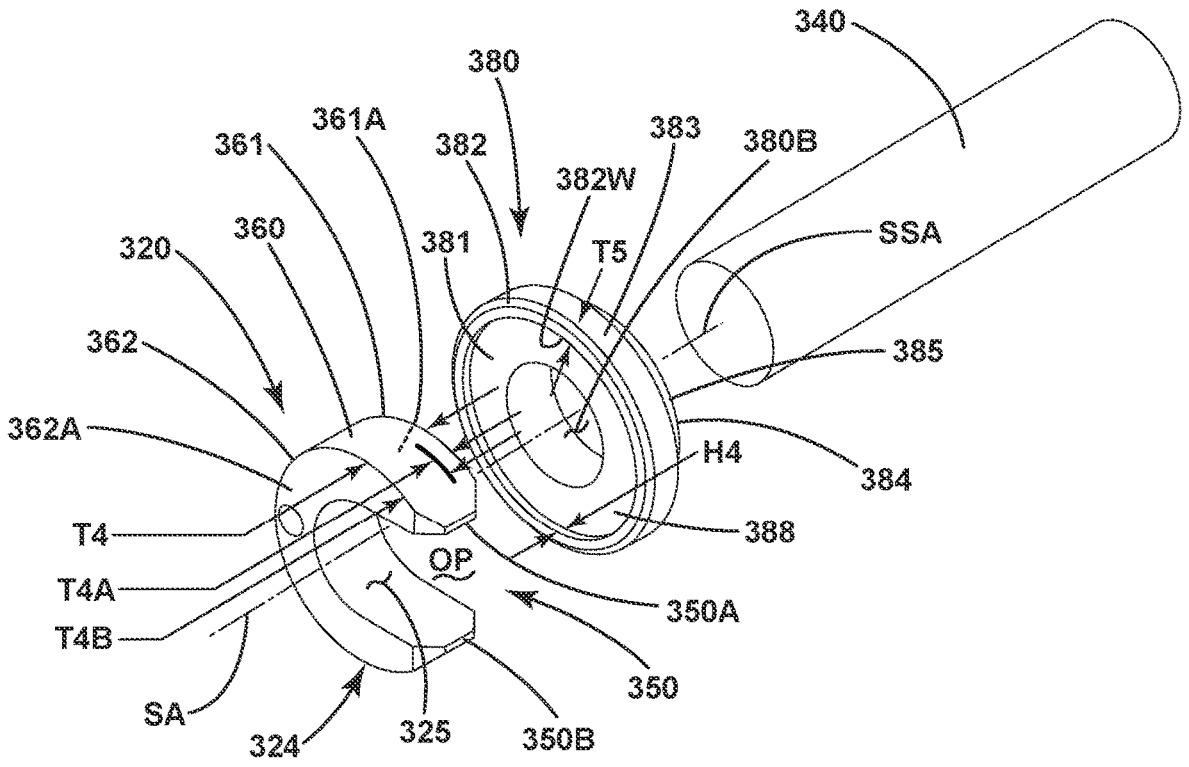
FIG. 11 is an exploded view of the open sided spacer and secondary spacer relative to the axle.
Figure 12:
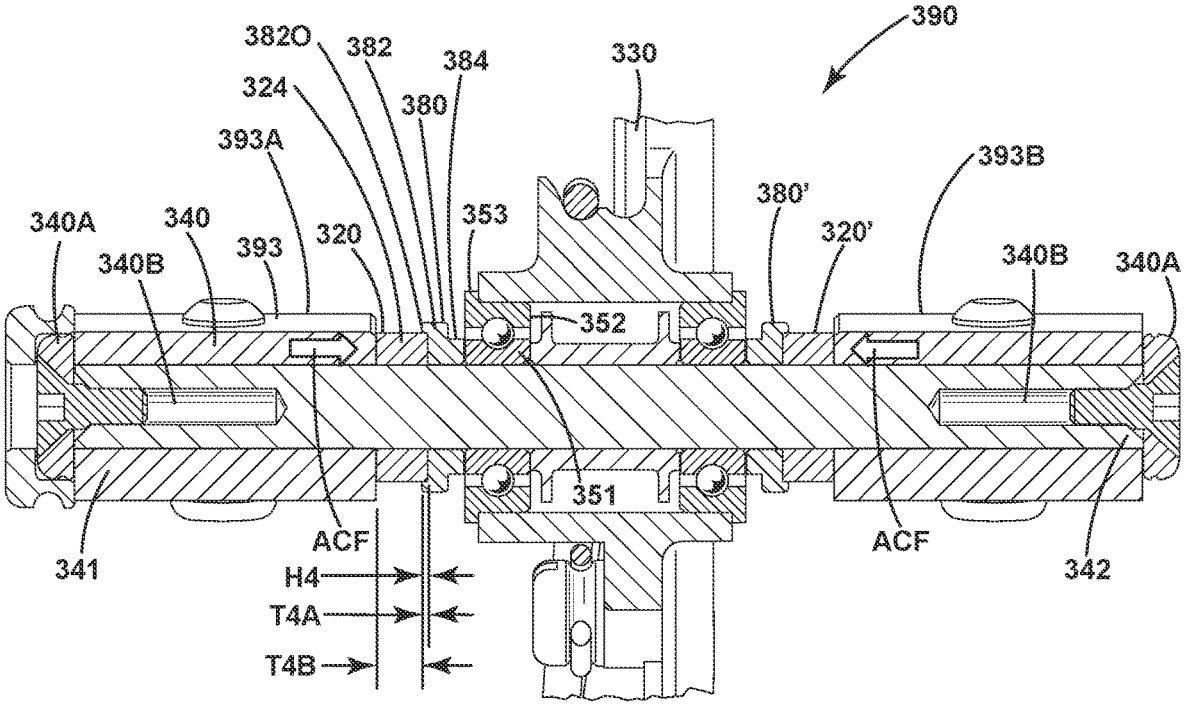
FIG. 12 is a section view of the open sided spacer interacting with the secondary spacer, with both installed relative to the axle in a limb recess and adjacent a cam of the archery bow.

A first alternative embodiment of a compound archery bow including one or more cams and an archery bow assembly is illustrated in FIGS. 10-12 and generally designated 390. The assembly can be similar in structure, function and operation to the embodiments described above with several exceptions. For example, the bow 390 can include a cam 330, which can be similar to the cam described above in connection with the embodiment above. Generally, the cam 330 can be rotatably mounted to a limb 393, which can be joined with the riser of the bow shown in FIGS. 1-9, and similar or identical to that construction so it will not be described again here. As shown in FIGS. 10 and 12, the assembly can include an axle 340 that can be similar or identical to the axle described in the embodiments above. Like the above embodiment the axle 340 can include one or more threaded bores 340B, optionally at one or more of the opposing ends of the axle 340. One or more fasteners 340A can be threaded into the bores 340B. When tightened, the fasteners 340A can exert an axial clamping force or compression force ACF in the directions of the arrows shown in FIG. 12. This axial clamping force ACF can be a compression force against all components that are disposed along the axle between the first end 341 and the second end 342 of the axle 340. This axial clamping force or compressive force is described in connection with the embodiments above, and is identical or similar to those embodiments, and will not be described again here. Generally, the respective components along the axle can be in direct engagement with one another. To the extent that other components, such as the outer portions of any bearings 350 and the cam 330 are not engaged by other components under the axial compression force ACF, those components can be free to rotate about the axle 340, again, as in the embodiments described above.

The embodiment of the bow assembly shown in FIGS. 10-12 also can include an open sided spacer 320 that is virtually identical to the open sided spacer 20, 120 and 220 as described above. Accordingly, that spacer will not be described again here in much detail. Suffice it to say that the open sided spacer 320 can include a spacer body 324 defining a longitudinal axis SA and axle aperture 325 which can be generally centered on the longitudinal axis SA. The axle aperture 325 can be configured to receive the axle 340 therein. The axle aperture can include a diameter that is slightly greater than or equal to the diameter of the axle 30 as described in connection with the embodiments above.

With reference to FIG. 11, the spacer body 324 of the open sided spacer 320 can include an outer perimeter 360 that can be identical to the outer perimeter described in connection with the embodiments above. The perimeter 360 can extend around the outer periphery of the spacer body and can be interrupted by a spacer recess 350 that extends inwardly toward the longitudinal axis SA and toward the axle aperture 325 so the spacer recess and axle aperture form a continuous opening OP. With this continuous opening, sometimes referred to as an axle slot, extending inwardly from the outer perimeter 360, the spacer body 324 optionally can take on a generally C-shape, U-shape or E-shape, similar or at uncle to the embodiment described above. The spacer body also can include forward surfaces, edges, sidewalls, corners, etc., that are similar or identical to those of the embodiments described in connection with the spacer body above and therefore not be described again here.

The outer perimeter 360 can be bounded by a first edge 361 and an opposing second edge 362. These edges can transition to respective first surface 361A and second surface 362A, which are on opposite sides or faces of the open sided spacer 320. These surfaces can face toward the cam 330 and/or a portion of the limb 393 when the open sided spacer is installed on the axle. Similar to the embodiments of the open sided spacers above, the spacer 320 can include a thickness T4 that extends from one surface 361A to an opposing surface 362A. This thickness T4 can vary depending on the application and the spacing for the cam along the axle. The thickness T4 however can include a first portion T4A of the thickness and a second portion T4B of the thickness. The first portion T4A can be optionally less than half, less than one third, less than one quarter or other portions of the full thickness T4. The second portion T4B can be optionally the balance of the thickness T4, such that the first portion thickness T4A plus the second portion thickness T4B equal the full thickness T4 of the spacer body from the first surface 361A to the second surface 362A.

The alternative embodiment shown in FIGS. 10-13 can include a secondary spacer 380, which can generally be configured to engage and/or otherwise be disposed proximal or adjacent the open sided spacer 320 and further secure that spacer 320 to the axle 340 of the archery bow 390. In particular, that secondary spacer 380 can maintain the open sided spacer 320 and its spacer body 324 mounted to the axle 340, for example, during times of abrupt movement of the axle and/or limb of the bow, such as during a shot, during significant impact or blows to the limb and/or the assembly components, when a force exerted on the open sided spacer 320 might disengage or dislodge it from the axle, or simply make it more likely that the spacer will slide relative to the axle.

The secondary spacer 380 optionally can be in the form of a cup spacer including a bore 380B that is configured to receive the axle 340 therein. The bore 380B can include a diameter that is slightly greater than the diameter of the axle 340, similar or identical to the diameter and dimensions of the axle aperture 325 of the open sided spacer 320. The bore can extend from the bottom wall or bottom surface or open sided spacer engagement surface 382 to an opposing inward facing surface 385. The bore 380B can be generally cylindrical, but of course can take on other shapes and configurations depending on the application, and in some cases can be open sided as well.

Figure 13:
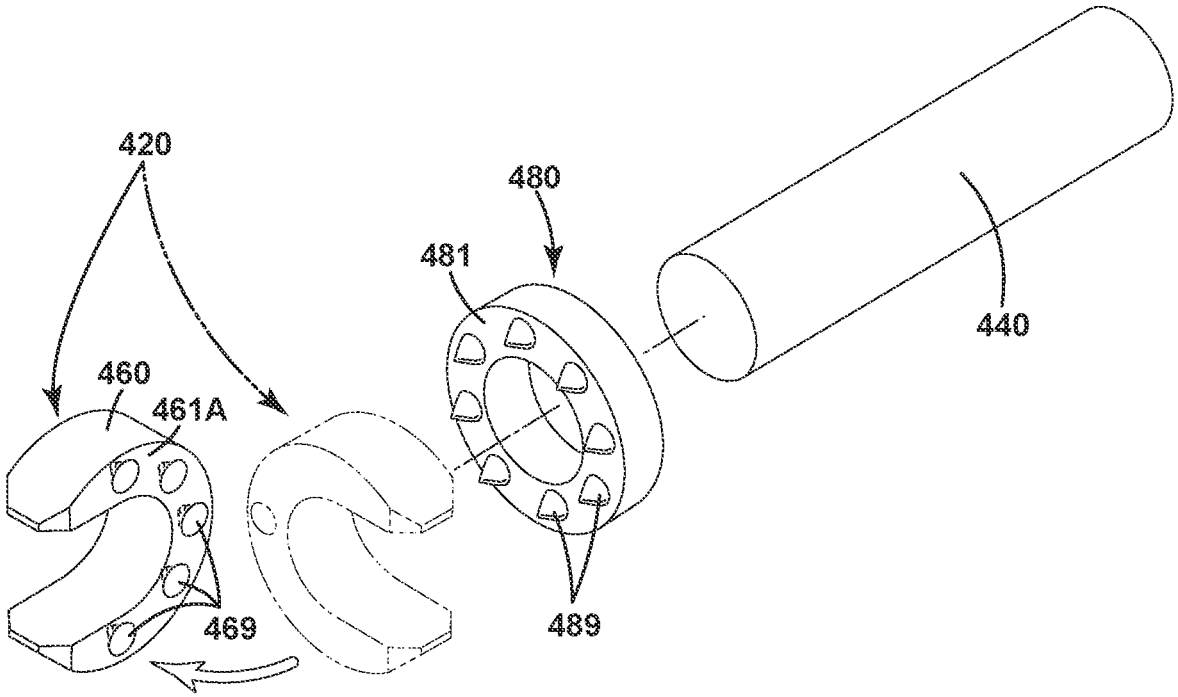
FIG. 13 is an exploded view of the open sided spacer and secondary spacer relative to axle in an axle assembly of a second alternative embodiment.

As shown in FIG. 13, the secondary spacer 380 can include a rim or shoulder 382 that extends around at least a portion of the bottom wall or engagement surface 381. As shown, the rim 382 can extend upward a height H4 away from the bottom wall 381. This height optionally can be about 0.500 inches, about 0.250 inches, about 0.100 inches, about 0.050 inches, about 0.025 inches, about 0.015 inches, about 0.010 inches, between about 0.100 inches and about 0.005 inches, inclusive, or other measurements depending on the application and the intended overlap of the portion of the secondary spacer body relative to the outer perimeter 360 of the spacer body 324. With the rim 382 extending around at least a portion of the bottom wall 381, the bottom wall and rim of the spacer can at least partially form a cup or recess 388. As mentioned above, optionally the rim 382 can be a full, solid and or continuous rim having a thickness from an inner wall 382 to an outer wall or periphery or perimeter 383 that forms the outer boundary of the secondary spacer 380. This thickness T5 as shown can be consistent and equal all the way around the rim and all the way around the secondary spacer axis SSA. This thickness optionally can be about 0.500 inches, about 0.250 inches, about 0.100 inches, about 0.050 inches, about 0.025 inches, about 0.015 inches, about 0.010 inches, between about 0.100 inches and about 0.005 inches, or other measurements depending on the application. Further optionally, although not shown, the rim can be interrupted such that the rim side wall 382W and the rim is discontinuous. In such a configuration, the wall 382W and rim 382 instead can be formed by multiple pins, posts or segments that form an interrupted or discontinuous rim around the secondary spacer axis SSA, radially outward from the bottom wall 381. In some cases, there might only be 1, 2, 3 or 4 structures that project around the bottom wall 381, sufficient to at least partially capture a portion of the spacer body 324 therein, such that the spacer body 324 is secured to the axle 340 when the secondary spacer 380 and open sided spacer 320 are installed on the axle 340 and the spacer body 324 is nested in the cup 388 or otherwise engaged by the rim or rim wall.

Optionally, the recess or cup 388 can be formed via the rim 382 extending around the secondary spacer axis SSA. The outer perimeter 360 of the spacer body 324 of the open sided spacer 320 can be in the form of a projection. The outer perimeter, in the form of a projection, can be placed within the recess or cup 388 so that the rim 382 surrounds the outer perimeter 360. In some cases, the surface 361A can come in direct contact and/or engage the bottom wall 381 of the secondary spacer 380. This can be achieved when both the open sided spacer 320 and the secondary spacer 380 are aligned and positioned on the axle 340. The outer perimeter 360 can fit within the cup or recess 388. The outer perimeter 360 can be disposed in the cup or recess such that it and/or the edge 361 is immediately adjacent, engaging and/or contacting the wall 382W of the rim 382. In some cases, there might be a small tolerance between the wall 382W and the outer perimeter 360. The edge 361 of the spacer body 324 can be disposed immediately adjacent and/or contacting the bottom wall 381 and/or the wall 382W of the rim 382. In other cases, the edge 361 and outer perimeter 360 can be spaced a small distance away from the rim 382 and/or its wall 382W. For example, these elements can be spaced somewhat radially inward, closer to the axis SSA and RSA of the components. Generally, however, the spacer body 324 and/or outer perimeter 360 can be disposed at least partially in the cup or recess 388 of the secondary spacer 380. In this configuration, the rim 382 can circumferentiate, surround or at least partially extend around at least a portion of the outer periphery 360 and the edge 361. That outer rim also can extend around and span across the spacer recess 350. Optionally, the rim 382 spans from a first boundary 350A of the spacer recess 350 to a second boundary 350B of the spacer recess 350. In some cases, it can span completely across this, to at least partially close off a portion of the opening OP at least for a first portion T4A of the thickness that corresponds to the height H4 of the rim 382 or wall 382W.

With further reference to FIGS. 11 and 12, the open sided spacer 320 and the secondary spacer 380 are shown installed on the axle 340 and relative to the cam 330, and in particular its bearings 353. The bearings 353 described in connection with this embodiment can be similar to the bearings 50 described in the embodiments above and therefore will not be explained again in detail here. Suffice it to say that the bearings 353 can include a first bearing 350A comprising a first inner portion 351 and a first outer portion 352. Between the first and inner and outer portions, one or more bearings in the form of balls can be disposed, identical or similar to the embodiment above. Further similar to the embodiment above, the axle 340 can include one or more fasteners 340A that are threaded in a respective bores 340B, optionally to exert a clamping or compressive force ACF. As a result, the arms 393A and 393B of the limb 393 move toward one another thereby compressing everything along the axle between those limbs in a compression mode or clamping mode.

When the fasteners are tightened, the axial compression force ACF compresses the open sided spacer 320 toward the cam 330 and more specifically against the secondary spacer 380. Even more particularly, the surface 361A of the spacer body 324 is compressed against the bottom wall 381 of the secondary spacer 380 such that the outer perimeter 360 at least partially enters the cup or recess 388. The compression continues and the compressive force is further transferred through the secondary spacer 380 such that a shoulder 384 of the secondary spacer engages the first inner portion 351 of the bearings 353, but not the first outer portion 352 of the bearings 353. The compressive force ACF transfers through the cam 330 and any other spacers or bearings therein to another set of the secondary spacer 380' an open sided spacer 320 on the opposite side of the cam 330. As a result, the open sided spacer 320, secondary spacer 380, components of the cam and bearings 353, the other secondary spacer 380' and other secondary open sided spacer 320' are compressed and/or clamped between the respective arms 393A, 393B of the assembly in the compression mode. The cam 330, as with the embodiment described above, remains rotatable relative to the axle 340 along with the first outer portion of the bearings 352. Accordingly, the cam can rotate during a draw cycle or shot cycle of the archery bow as described in connection with the embodiment above.

When the fasteners 340A are tightened relative to the axle and the assembly undergoes a compression mode, the spacer body 324 at least partially enters or inserts into the cup or recess 388. The spacer body outer perimeter 360 and the outer edge 361 optionally are circumferentiated by the rim 382 and rim wall 382W. Again, the spacer recess 350 can be disposed adjacent the rim so that the rim spans from the first boundary 358 of the second boundary 350B. The outer perimeter 360 and spacer body 324 also enter and extend into the recess a distance equal to the height H4. Accordingly, a first portion T4A of the overall thickness T4 of the spacer body 324 can be disposed in the recess, with the rim extending upward along and concealing that first portion T4A of the thickness T4. The remaining second portion T4B of the thickness T4 can remain uncovered and can extend beyond the outer most portion 3820 of the rim 382. When the open sided spacer 320 is disposed at least partially in the cup or recess 388, optionally, the first portion T4A of the thickness is disposed in the cup, while the second portion T4B of the thickness T4 is disposed outside the cup, and can protrude upward and away from the rim 382 and beyond the outer surface 3820 thereof.

When the fasteners 340A are tightened and/or the open sided spacers and secondary spacers are in a compression mode, clamped between the respective limb arms 393A and 393B, and the cam 330, each secondary spacer effectively traps the respective open sided spacer such that the spacer body 324 in this compression mode is nonremovable from the axle 340 of the archery bow in a secured mode. Accordingly, when the axle moves and then stops or changes direction rapidly, for example during a shot cycle of the bow, the open sided spacers are impaired from being ejected, dislodged or disengaged from the axle. Again, this is because the open sided spacers are at least partially trapped within the cup or recess 388 of each of the respective secondary spacers 380, 380' in the secured mode.

To remove the open sided spacers from the axle, for example to change out one spacer for another of a different thickness, the fasteners 340A can be loosened. In so doing, the assembly can convert from a compressed or compression mode to an uncompressed mode and unsecured mode. In this mode, the axle compression force ACF is not exerted against the open sided spacers, the secondary spacers and/or the cam bearings, and/or generally that force is decreased substantially. As a result, the limb arms 393A and 393B optionally can move slightly away from one another and/or the cam 330 or bearings 350. As a result, the spacer body 324 can be moved out of or disengaged from the secondary spacer cup or recess 388. In turn, the spacer body can clear the rim 382 and can disengage or move away from the bottom wall 381. The outer perimeter 360 is no longer disposed in the recess 388. As a result, the particular open sided spacer 320 can be pressed or moved laterally or radially away from the axis LA so as to disengage the spacer from the axle 340, with the axle traversing out the opening OP. In this manner, the open sided spacers 320 can be removed from the axle 340 without removing the axle from the limbs and/or limb arms.

Optionally, the secondary spacer 380 remains secured to the axle 340 such that removal of the secondary spacer in some cases only can be performed by removing the axle 340 from the limb. Further optionally, the secondary spacer can circumferentiate the axle and is not removable from the axle without removing the axle from the limb arms and the cam. In these cases, the secondary spacer can circumferentiate the majority of the outer perimeter of the axle 340, surrounding it, so that is not easily removed, as is the case with the open sided spacer 320. Generally however, this activity is not performed because the cam 330 can be centered and/or spaced on the axle 340 simply by placing the open sided spacers with appropriate thicknesses thereon.

Figure 14:
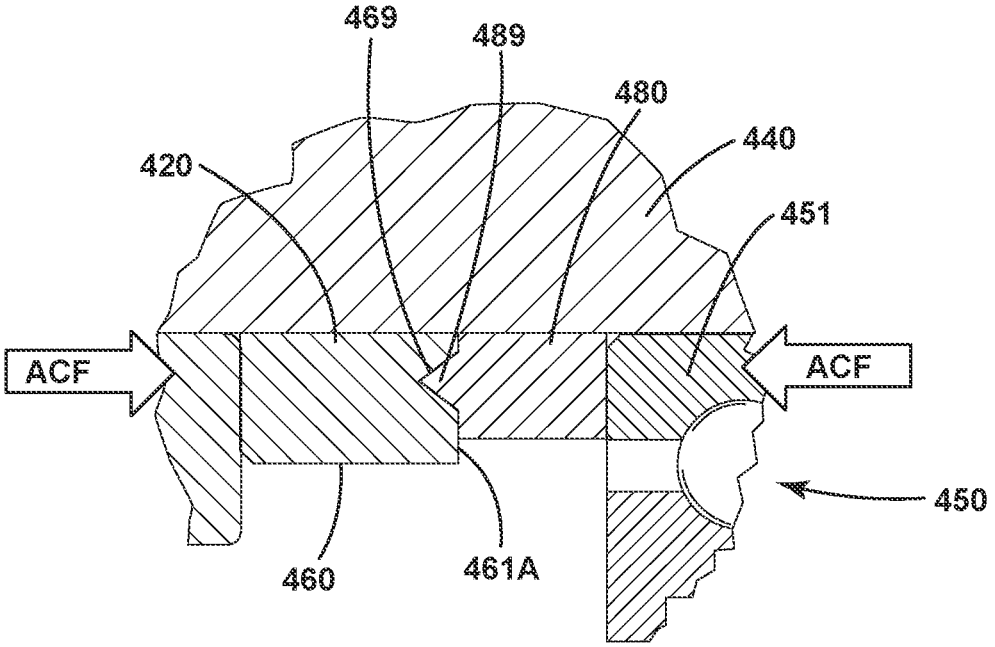
FIG. 14 is a close-up section view of the open sided spacer interacting with the secondary spacer, with both installed relative to the axle.

A second alternative embodiment of the assembly and in particular a different construction for the secondary spacer is shown in FIGS. 13 and 14. This embodiment can be similar in structure, function and operation to the embodiments described above with several exceptions. For example, in this construction, the open sided spacer 420 can be placed on and/or removed from the axle 440, similar to the embodiments above. In this embodiment however, the open sided spacer 420 can include multiple recesses 469 that are disposed on a surface 461A that is configured to face toward and engage a bottom wall or surface 481 of a secondary spacer 480. The secondary spacer 480 can be similar to the secondary spacer above, however, it can be modified to include multiple projections 489 that fit into and are received by the respective recesses 469 of the open sided spacer 420. For example, as shown in FIG. 14, when the assembly is placed under an axial compression force ACF in a compression mode, the projections 489 associated with the secondary spacer 480 can enter into and seat within the recesses 469 defined by the open sided spacer 420. When this occurs, the secondary spacer 480 can secure the open sided spacer 420 to the axle 440 so that it cannot disengage from that axle and is generally impaired from disengaging from that axle 440 in a secured mode. The secondary spacer body 480 also can be configured so that it engages substantially only the inner portion 451 of the bearings 450 so that the cam can freely rotate about the axle, while the remainder of the components are compressed along the axle as described in connection with the embodiments above. Optionally, the projections and recesses to achieve the securement of the open sided spacer with the secondary spacer can be reversed or mixed and matched, depending on the application. Further, the respective projections and recesses can take on a variety of different configurations, such as the conical recesses and projections as shown, or dimples and detents, or pins, posts and corresponding holes of virtually any geometric configuration that allows the secondary body 480 to secure to the open sided spacer 420 and impair that open sided spacer 420 from becoming dislodged or disengaged from the axle 440. The operation, installation and removal or adjustment of the open sided spacer 420 and secondary spacer 480 can be similar or identical to that of the embodiments of the open sided spacer and secondary spacer above, and will not be described again here.

Although the different elements and assemblies of the embodiments are described herein as having certain functional characteristics, each element and/or its relation to other elements can be depicted or oriented in a variety of different aesthetic configurations, which support the ornamental and aesthetic aspects of the same. Simply because an article, element or assembly of one or more elements is described herein as having a function does not mean its orientation, layout or configuration is not purely aesthetic and ornamental in nature.

Directional terms, such as "vertical," "horizontal," "top," "bottom," "upper," "lower," "inner," "inwardly," "outer" and "outwardly," are used to assist in describing the invention based on the orientation of the embodiments shown in the illustrations. The use of directional terms should not be interpreted to limit the invention to any specific orientation(s).

In addition, when a component, part or layer is referred to as being "joined with," "on," "engaged with," "adhered to," "secured to," or "coupled to" another component, part or layer, it may be directly joined with, on, engaged with, adhered to, secured to, or coupled to the other component, part or layer, or any number of intervening components, parts or layers may be present. In contrast, when an element is referred to as being "directly joined with," "directly on," "directly engaged with," "directly adhered to," "directly secured to," or "directly coupled to," another element or layer, there may be no intervening elements or layers present. Other words used to describe the relationship between components, layers and parts should be interpreted in a like manner, such as "adjacent" versus "directly adjacent" and similar words. As used herein, the term "and/or" includes any and all combinations of one or more of the associated listed items.

The above description is that of current embodiments of the invention. Various alterations and changes can be made without departing from the broader aspects of the invention as defined in the appended claims, which are to be interpreted in accordance with the principles of patent law including the doctrine of equivalents. This disclosure is presented for illustrative purposes and should not be interpreted as an exhaustive description of all embodiments of the invention or to limit the scope of the claims to the specific elements illustrated or described in connection with these embodiments. For example, and without limitation, any individual element(s) of the described invention may be replaced by alternative elements that provide substantially similar functionality or otherwise provide adequate operation. This includes, for example, presently known alternative elements, such as those that might be currently known to one skilled in the art, and alternative elements that may be developed in the future, such as those that one skilled in the art might, upon development, recognize as an alternative. Further, the disclosed embodiments include a plurality of features that are described in concert and that might cooperatively provide a collection of benefits. The present invention is not limited to only those embodiments that include all of these features or that provide all of the stated benefits, except to the extent otherwise expressly set forth in the issued claims. Any reference to claim elements in the singular, for example, using the articles "a," "an," "the" or "said," is not to be construed as limiting the element to the singular. Any reference to claim elements as "at least one of X, Y and Z" is meant to include any one of X, Y or Z individually, any combination of X, Y and Z, for example, X, Y, Z; X, Y; X, Z; Y, Z, and/or any other possible combination together or alone of those elements, noting that the same is open ended and can include other elements.

What is claimed is:

1. An archery bow assembly comprising:

a spacer body defining a longitudinal axis and defining an axle aperture that surrounds the longitudinal axis, the aperture receiving an axle of an archery bow upon which a cam rotatably mounts; and an outer perimeter extending around the spacer body, the outer perimeter interrupted by a spacer recess that extends inwardly toward the longitudinal axis and the axle aperture so that the spacer recess and axle aperture cooperate to form a common opening, wherein the spacer body mounts to the axle of the archery bow within a limb recess, and is removable from the axle without removing the axle from a limb of the archery bow.

2. The archery bow assembly of claim 1, comprising:

a cup spacer including a bottom wall and a rim extending around at least a portion of the bottom wall to form a cup, wherein the outer perimeter of the spacer body is at least partially disposed in the cup, whereby the cup spacer maintains the spacer body mounted to the axle of the archery bow.

3. The archery bow assembly of claim 2, comprising:

a first bearing comprising a first inner portion and a first outer portion; and a fastener joined with the axle and operable in a compression mode to thereby compress under a compression force the first inner portion against the cup spacer, wherein the first outer portion remains uncompressed when the compression force is applied.

4. The archery bow assembly of claim 3, wherein the fastener in the compression mode compresses the spacer body against the bottom wall under the compression force, with the spacer body outer perimeter being at least partially surrounded by the rim.

5. The archery bow assembly of claim 2, wherein the spacer body outer perimeter is circumferentiated by the rim, wherein the spacer recess is disposed adjacent the rim so that the rim spans from a first boundary of the spacer recess to a second boundary of the spacer recess.

6. The archery bow assembly of claim 1, wherein the axle aperture includes an axle aperture diameter, wherein the axle includes an axle diameter, wherein the axle aperture diameter is greater than the axle diameter, wherein the spacer recess has a width that is less than the axle aperture diameter.

7. The archery bow assembly of claim 1, wherein the spacer body includes a thickness between about 0.050 inches and about 0.300 inches, wherein the axle is at least partially cylindrical.

8. The archery bow assembly of claim 1, wherein the spacer body is clamped via a compressive force between opposing limb arms of the limb.

9. The archery bow assembly of claim 1 comprising:

a secondary spacer positioned adjacent the spacer body;

a projection engaging a recess to secure the secondary spacer in engagement with the spacer body in a secured mode so that the spacer body is unremoveable from the axle of the archery bow in the secured mode.

10. The archery bow assembly of claim 9, wherein the secondary spacer engages the spacer body under a compressive force in the secured mode.

11. An archery bow assembly comprising:

a limb defining a limb recess;

an axle joined with the limb;

a cam rotatably mounted relative to the axle within the limb recess;

an open sided spacer including a body defining a longitudinal axis and an axle aperture that surrounds the longitudinal axis, the axle aperture receiving the axle, the body including an outer perimeter interrupted by a spacer recess that extends inwardly toward the longitudinal axis and the axle aperture so that the spacer recess and axle aperture form a continuous opening, the open sided spacer joined with the axle in the limb recess adjacent the cam;

wherein the open sided spacer is mountable to the axle and is removable therefrom without removing the axle from the limb.

12. The archery bow assembly of claim 11, comprising:

a secondary spacer registered with the open sided spacer to impair the open sided spacer from disengaging the axle, the secondary spacer allowing the open sided spacer to be removeable from the axle without removing the axle from the limb.

13. The archery bow assembly of claim 12, wherein the secondary spacer circumferentiates the axle and is not removeable from the axle without removing the axle from the limb.

14. The archery bow assembly of claim 11, comprising:

a secondary spacer defining a cup within which the open sided spacer is at least partially positioned to impair the open sided spacer from disengaging the axle.

15. The archery bow assembly of claim 11, comprising:

a secondary spacer including a rim extending from a secondary spacer body, the rim defining a secondary spacer recess, wherein the open sided spacer is disposed in the secondary spacer recess and surrounded so that the open sided spacer is trapped therein.

16. The archery bow assembly of claim 11, comprising:

a bearing mounted to the cam adjacent the open sided spacer;

a secondary spacer mounted to and surrounding the axle; and a fastener joined with the axle and operable in a compression mode to thereby compress under a compression force the open sided spacer against the secondary spacer to trap the open sided spacer relative to the axle, and the secondary spacer against the bearing with the cam remaining rotatable relative to the axle.

17. A method of using an archery bow assembly, the method comprising:

providing an axle installed relative to opposing arms of a limb of an archery bow, with a cam rotatably mounted on the axle in a limb recess between the opposing arms, the axle including a longitudinal axis;

moving a secondary spacer defining a cup toward an open sided spacer on the axle within the limb recess, the open sided spacer defining a spacer recess common with an axle aperture of the open sided spacer, wherein the open sided spacer is installed at least partially within the cup on the axle without removing the axle from the opposing arms of the limb, wherein the secondary spacer impairs the open sided spacer from disengaging the axle when the archery bow is in use.

18. The method of claim 17, comprising:

compressing the secondary spacer between the open sided spacer with a compression force between 1 pound and 500 pounds, inclusive.

19. The method of claim 17 comprising:

placing a rim of the secondary spacer around at least a portion of an outer perimeter of the open sided spacer, wherein rim spans across the spacer recess.

20. The method of claim 19, wherein the open sided spacer includes a thickness, wherein a first portion of the thickness is disposed in the cup, wherein a second portion of the thickness is disposed outside the cup.

* * * * *